US005493073A

United States Patent [19]

Honkomp

[11] Patent Number: 5,493,073

[45] Date of Patent: Feb. 20, 1996

[54] INSULATING ARRANGEMENT FOR A FUSED HERMETIC TERMINAL ASSEMBLY

[75] Inventor: Glenn A. Honkomp, Warren County, Ohio

[73] Assignee: Emerson Electric Co., St. Louis, Mo.

[21] Appl. No.: 251,340

[22] Filed: May 31, 1994

[51] Int. Cl.[6] ..... H01R 13/02

[52] U.S. Cl. ..... 174/152 GM; 439/181; 439/150; 439/521; 439/693

[58] Field of Search ..... 174/152 GM, 138 F, 174/74 A; 439/181, 183, 186, 187, 135, 149, 150, 367, 519, 521, 566, 621, 622, 685, 693, 892, 893; 337/0.1, 273, 181, 276, 279, 405; 417/422, 902

[56] References Cited

U.S. PATENT DOCUMENTS 3,160,460 12/1964 Wyzenbeck ..... 339/176
3,605,076 9/1971 Dozier ..... 174/153 R X
3,988,053 10/1976 Dodenhoff ..... 339/278
4,174,145 11/1979 Oeschger et al. ..... 174/152 GM X
4,252,394 2/1981 Miller ..... 339/94
4,296,275 10/1981 Bowsky ..... 174/152
4,584,433 4/1986 Bowsky et al. ..... 174/152
4,609,774 9/1986 LeMieux et al. ..... 174/152
5,017,740 5/1991 Honkomp et al. ..... 174/152
5,227,587 7/1993 Paterek ..... 174/152 GM

*Primary Examiner*—Morris H. Nimmo
*Assistant Examiner*—Paramita Ghosh
*Attorney, Agent, or Firm*—Polster, Lieder, Woodruff & Lucchesi

[57] ABSTRACT

A hermetic terminal assembly structure adapted to be sealed along the periphery of an aperture in a chamber defining housing wall of a hermetically sealed chamber including a terminal pin sealed by a coalescent aperture seal in the aperture to include inner and outer pin portions, each of which pin portions is surrounded by one of a pair of sleeve members sealingly cooperative with the aperture seal.

10 Claims, 2 Drawing Sheets

INSULATING ARRANGEMENT FOR A FUSED HERMETIC TERMINAL ASSEMBLY

BACKGROUND OF THE INVENTION

The present invention relates to hermetic terminal assembly construction and more particularly to a terminal pin insulating arrangement for a hermetic terminal structure adapted to be sealed along the periphery of an aperture in a chamber defining housing wall.

It is known in the art of hermetic terminal assemblies to employ a current carrying electrically connected and conductive terminal pin which is surrounded by an insulating sleeve member located on the inner portion of the pin on the inner apertured dish side face of the bottom wall of a cup-shaped body of the terminal pin. The outer peripheral rim of the cup-shaped body is sealed along the periphery of an aperture in a chamber defining wall and the terminal pin, including inner and outer pin portions, is sealed intermediate such pin portions in the apertured bottom wall of the cup shaped body along with the end of the insulating sleeve member surrounding the inner pin portion. Such a structural arrangement can be seen in U.S. Pat. No. 4,584,433, issued to Benjamin Bowsky et al on Apr. 22, 1986 and in U.S. Pat. No. 5,017,740, issued to Glenn A. Honkomp et al on May 21, 1991, these two patents further disclosing a well recess in the pin surrounding sleeve member to provide an extended oversurface or tortuous path between the surrounded inner terminal pin portion and the cup shaped body. Fuse-like areas are also disclosed in each of these two patents with U.S. Pat. No. 4,584,433 showing such fuse-like area within the well recess of the surrounding sleeve member on the inner face of the cup-shaped body and U.S. Pat. No. 5,017,740 showing such fuse-like area embedded in a polymeric rubber silicone coating on the outer face of the cup shaped body. In this regard, insulative coatings on the outer face of terminal cup bodies have been generally well and long known in the art, attention being directed to U.S. Pat. No. 3,160,460, issued to A. Wyzenbeck on Dec. 8, 1964; U.S. Pat. No. 3,988,053, issued to John A. Dodenhoff on Oct. 26, 1976; U.S. Pat. No. 4,252,394, issued to Austin S. Miller on Feb. 24, 1981; U.S. Pat. No. 4,296,275, issued to Benjamin Bowsky on Oct. 20, 1981; and U.S. Pat. No. 4,609,774, issued to David M. LeMieux et al on Sep. 2, 1986.

The present invention recognizes that such outside insulative coatings as used in the prior art have been comparatively expensive and complex in materials, manufacture, application, durability and maintenance, necessarily requiring a uniformly even body surface for application and having limitations in bonding ability and resistance to degradation with temperature variations accompanied by occasional "doming" of the body surface during high pressure operations. The present invention recognizing these deficiencies in the prior art outside insulative coating practices provides for an economic and straightforward insulating structure which accommodates for high temperature variations and which allows for indentations of the cup shaped body member, resisting possible "doming" as a consequence of high pressures in the hermetically sealed housing chamber. In addition, the present invention provides for the economical, low cost use of existing materials, allowing for ready manufacture and assembly with minimal maintenance and, at the same time, insuring extended oversurfaces to reduce the possibilities of undesirable arcing. Further, the present invention allows for unitary manufacture of substantially identical mirror-image sleeve pairs when so desired, thus reducing the costs and number of process operations and, at the same time, providing terminal pin shielding.

Various other features of the present invention will become obvious to one skilled in the art upon reading the disclosure set forth herein.

SUMMARY OF THE INVENTION

More particularly, the present invention provides a hermetic terminal assembly structure adapted to be sealed along the periphery of an aperture in a chamber defining housing wall comprising: a terminal pin capable of extending through the aperture of the housing wall to include inner and outer pin portions extending respectively within and without the housing wall; sealing assembly means including a coalescent bonding material or seal cooperative and extending between the periphery of the terminal pin between the inner and outer pin portions and the periphery of the aperture in the housing wall to hermetically seal the inner portion of the terminal pin within the housing wall and the outer portion of the terminal pin without the housing wall; and, a pair of sleeve members respectively surrounding the inner and outer pin portions of the terminal pin, at least one of the sleeve members being shaped to form a well recess surrounding a part of the peripheral surface of a pin portion to provide an extended oversurface with the pin portion to reduce possible arcing of the pin portion, the pair of sleeve members being sealingly cooperative with the coalescent bonding seal of the sealing assembly means. In addition, the present invention provides a modified arrangement wherein the pair of insulating sleeve members are joined together by an intermediate neck portion to provide an integral sleeve construction through which the terminal pin passes and seals to the inner periphery thereof, the outer periphery of the intermediate neck portion sealing to the periphery of the aperture in the housing wall.

It is to be understood that various changes can be made by one skilled in the art in one or more of the several parts of the novel terminal assembly structure disclosed herein without departing from the scope of spirit of the present invention.

BRIEF DESCRIPTION OF THE DRAWINGS

Referring to the drawings which disclose an advantageous embodiment of the present invention, including a modified construction of the pair of insulating sleeves.

DETAILED DESCRIPTION OF THE DRAWING

Figures 1, 2:
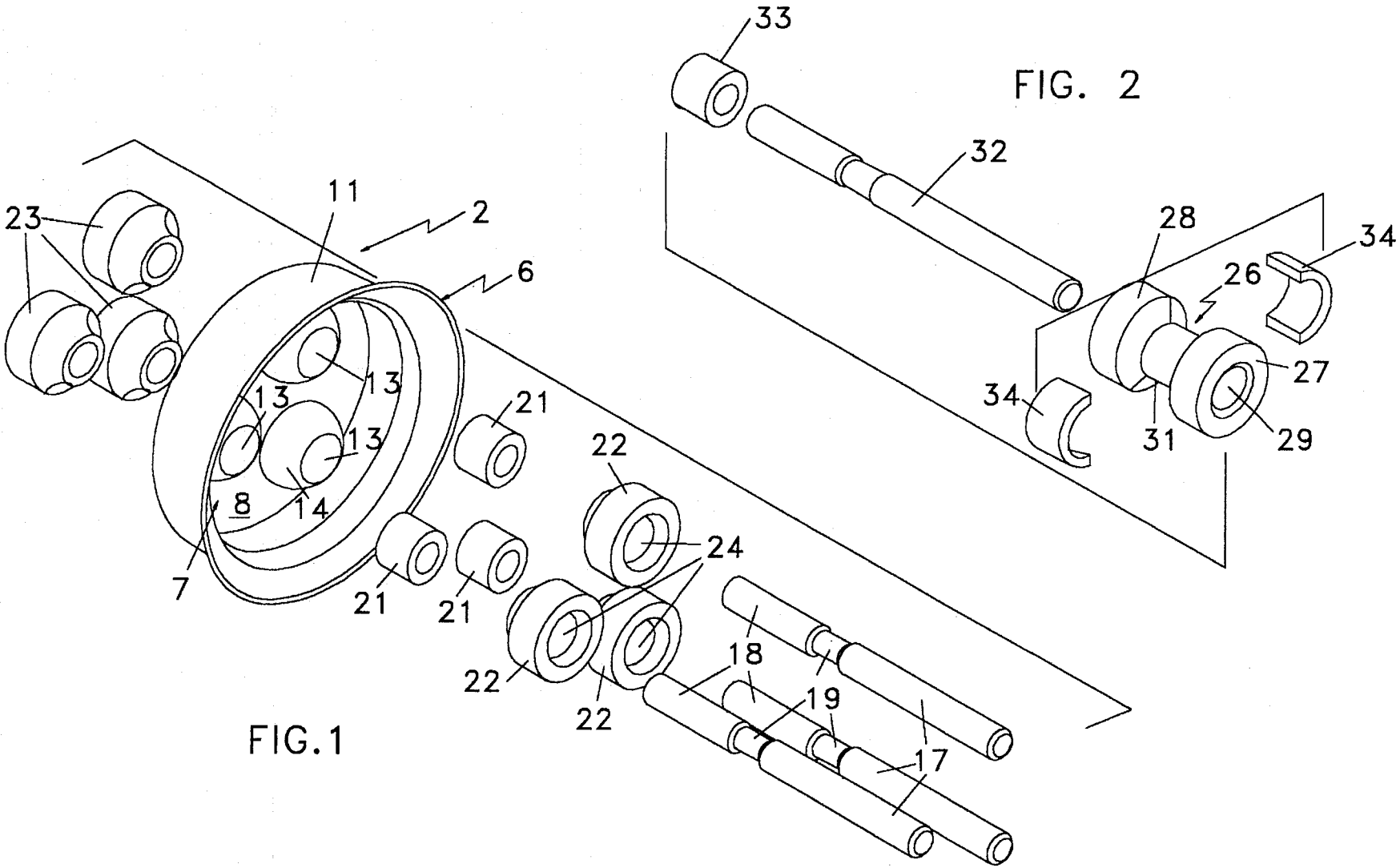
FIG. 1 is an exploded isometric view of a hermetic terminal assembly structure incorporating the novel features of the present invention.
FIG. 2 is an exploded isometric view of a novel modified insulating sleeve arrangement which can be utilized in place of the novel sleeve arrangement disclosed in the hermetic terminal assembly of FIG. 1.
Figure 3:
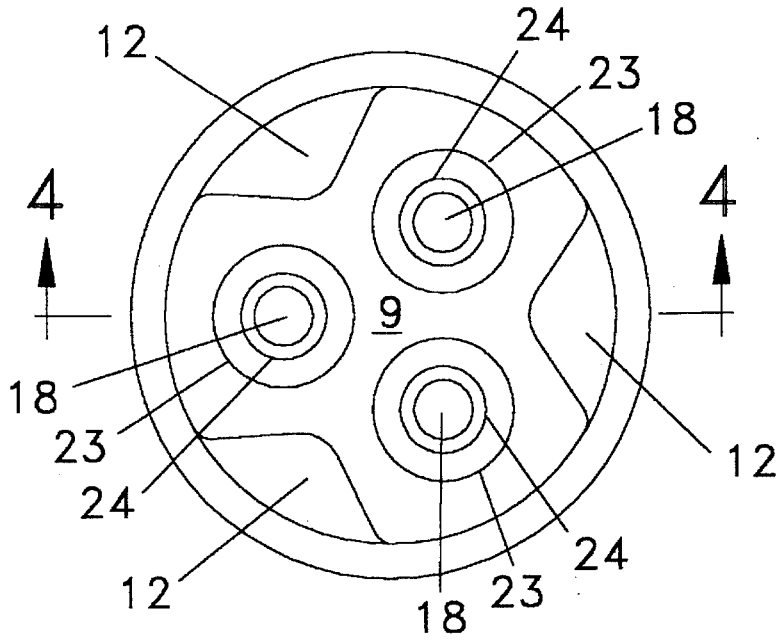
FIG. 3 is a top plan view of the terminal assembly of FIG. 1.
Figure 4:
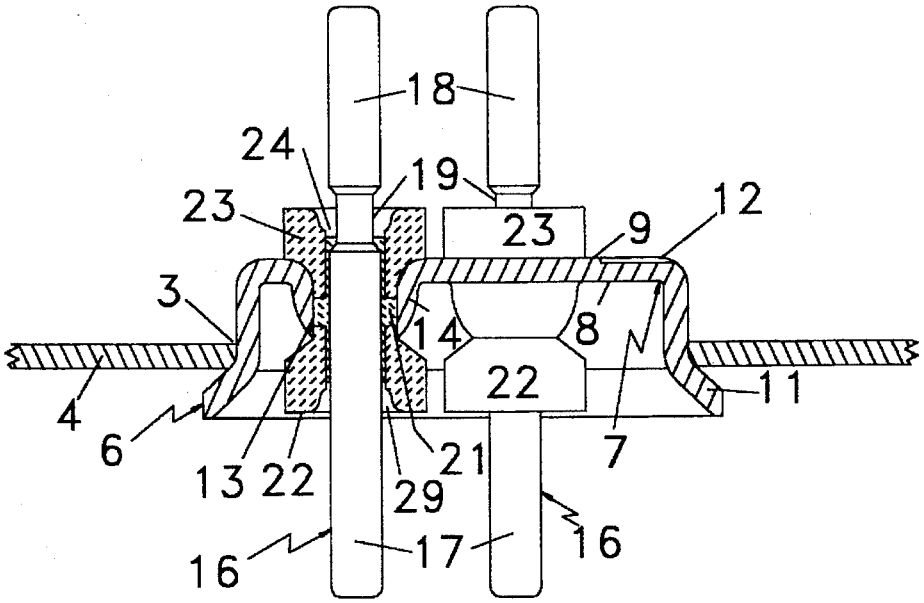
FIG. 4 is a cross-sectional partially broken view of the inventive hermetic terminal assembly of FIGS. 1 and 3 taken in a plane through line 4—4 of FIG. 3, a portion of the assembly being broken away to more fully disclose the inventive features.

Referring to FIGS. 1, 3 and 4 of the drawings, the unique and novel hermetic terminal assembly 2 which can be appropriately sized and shaped to be sealed in an aperture 3 of chamber defining housing wall 4 (FIG. 4) is disclosed. Chamber defining housing wall 4 can be part of a housing of a refrigerator compressor (not shown). Hermetic terminal assembly 2 includes a cup-shaped body which can be formed from a suitable material, such as metal or even plastic material, to include a bottom wall 7 having an inner face 8, an outer face 9 and a flared rim or side wall 11 which extends from the inner face 8 of bottom wall 7. In accordance with one feature of the present invention, bottom wall 7 advantageously can include a plurality of preselectively shaped and positioned stamped indentations 12, here shown as spaced triangles with the base of each triangle extending inwardly toward the center from the periphery of bottom wall 7, so as to spacedly surround the disclosed group of apertures 13 extending through bottom wall 7. These novel indentations 12 serve to strengthen bottom wall 7 and to resist possible "doming" of the bottom wall as a consequence of high pressure variations which might occur within the chamber defining wall 4. It is to be noted that this feature of indentations is, in turn, a consequence of the overall unique structural arrangement described herein and particularly the novel terminal pin insulating arrangement described hereinafter.

It is to be understood that the present invention should not be considered as limited to the particular indentation arrangement disclosed, including the spacing and shaping of the indentations, but that other indentation shapes and other spacings can be employed, depending upon the overall terminal assembly construction, without departing from the scope or spirit of the invention. Further, it is to be understood that the present invention should not be considered as limited to the particular aperture arrangement for the cup shaped body as disclosed, but that other aperture arrangements, including one or more apertures, can also be utilized.

As can be seen in the drawings, the cup shaped body 6 is, in fact, provided with three spaced apertures 13, each of which includes an annular sealing lip 14 extending from the inner face 8 of bottom wall 7. Apertures 13, each serve to accommodate a terminal electrical current conducting pin 16 which advantageously can be formed from a corrosion resistant stainless steel with high chromium content. Each pin 16, extending through bottom wall aperture 13 includes an inner pin portion 17 to extend within and be hermetically sealed within a chamber defined by the chamber defining housing wall 4 and an outer pin portion 18 extending without or outside such defined chamber. Except for reduced fuse-like section 19, each terminal pin disclosed is of uniform cross-section with fuse-like section 19 being a part of the outer pin portion 18. The outer pin portion 18 serves to be connected to a suitable electric current source not shown and the inner pin portion 17 to an electrical unit (not shown) within the chamber defined by wall 4 (not shown). It is to be understood that, if so desired, such a fuse-like section can be positioned in inner pin portion 17 instead, or fuse-like sections can be positioned in both pin portions, or even can be entirely excluded as part of the terminal pin.

As can be particularly seen in FIGS. 1 and 4 of the drawings, a coalescent glass seal 21 is provided to extend between the periphery of each of the terminal pins 16 (here shown as being from the periphery of inner pin portion 17) to the periphery of a lip portion 14 serving to define aperture 13 in bottom wall 7 so as to hermetically seal the inner pin portion 17 of terminal pin 16 within aperture 13 and the outer pin portion 18 of pin 16 without or outside aperture 13.

In accordance with still another feature of the present invention a pair of inner and outer insulating sleeve members 22 and 23 are provided to respectively surround inner pin portion 17 and outer pin portion 18 of each terminal pin 16. The insulating sleeve member pair 22 and 23 advantageously can be of a suitably selected ceramic material with the sleeves of the pair positioned in spaced mirror-image relationship so that the proximal ends thereof are in spaced and sealingly embedded relation with coalescent glass seal 21 on opposite sides thereof. The distal ends of each pair of inner and outer sleeves are so shaped to each form a well recess 24 which surrounds a part of the peripheral surface of the inner and outer pin portions 17 and 18 respectively. With such an arrangement, each inner and outer pin portion is provided with an extended oversurface to reduce possible arcing of both the inner and outer pin portions so that prior art outer cup shaped body coatings are eliminated and the possibilities of "doming" minimized. It is to be further noted, as in FIG. 4, that major portion of each of the fuse-like sections 19 can be arranged to fall within a well recess 24 to thus allow a reducation of overall pin length.

Referring to FIG. 2 of the drawings, a modified embodiment of the invention is disclosed to include for each aperture 13 an integral sleeve arrangement 26 comprised of a pair of mirror-image inner and outer sleeve members 27 and 28 respectively. Each sleeve pair 27 and 28 is similar in shape and size to aforedescribed sleeve pair 22 and 23, with each sleeve of a pair including a well recess 29 similar to well recess 24. However, instead of having the proximal ends of a pair spaced and embedded in opposite sides of glass seal 21, like aforedescribed inner and outer sleeve pair 23 and 24, the proximal ends of each sleeve pair 27 and 28 in sleeve arrangement 26, are integrally joined at opposite ends by tubular neck portion 31 to thus provide an integral sleeve construction through which terminal pin 32, similar to terminal pin 16, passes. The inner periphery of pin 32 is sealed to the inner periphery of tubular neck portion 31 by annular glass seal 33 and the outer periphery of tubular neck portion 31 is sealed to the annular sealing lip 14 defining aperture 13 by outer split annular glass seal 34. Thus, the modified integral structural sleeve arrangement 26, of FIG. 2, provides an inner and outer insulating sleeve member to insulatively surround, protect and create an oversurface for both the inner and outer pin portions in a manner similar to aforedescribed spaced insulator sleeves 22 and 23 of FIGS. 1, 3 and 4.

It is to be understood that the present invention is not to be considered as limited to the particular cup shaped body, as disclosed, the features of the present invention being employable in other hermetic terminal assemblies where at least one terminal pin passes through an aperture in a chamber defining housing wall and desirably is hermetically sealed thereto to provide inner and outer pin portions for electrical current connections.

The invention claimed is:

1. A hermetic terminal assembly structure adapted to be sealed along the periphery of an aperture in a chamber defining housing wall comprising:

a terminal pin capable of extending through said aperture of said housing wall to include inner and outer pin portions extending respectively within and without said housing wall, said housing wall including an irregular indented wall portion surrounding said terminal pin with spaced indentations serving to strengthen and resist doming thereof;

sealing assembly means including a fusible coalescent bonding seal cooperative with and extending between the periphery of said terminal pin between said inner and outer pin portions and said periphery of said aperture in said housing wall to hermetically seal the inner portion of said terminal pin within said housing wall and the outer portion of said terminal pin without said housing wall; and, a pair of insulating sleeve members respectively surrounding the inner and outer pin portions of said terminal pin, at least one of said sleeve members being shaped to form a well recess surrounding a part of the peripheral surface of one of said pin portions to provide extended oversurface with said one of said pin portions to reduce possible arcing of said one of said pin portions, the pair of sleeve members being sealingly cooperative with the coalescent bonding seal of said sealing assembly means.

2. The hermetic terminal assembly structure of claim 1, said one of said pair of sleeve members being of ceramic material with the distal end thereof being shaped in the form of said well recess to provide said extended oversurface.

3. The hermetic terminal assembly structure of claim 1, said pair of sleeve members being substantially identical in shape and positioned relative said sealing assembly means in opposed mirror-image relationship.

4. The hermetic terminal assembly structure of claim 1, said sealing assembly means including a cup shaped body with a bottom wall having an inner and outer face and a rim extending from said inner face of said bottom wall having the outer periphery sealed to the periphery of said housing wall aperture, said bottom face having an aperture therein through which said terminal pin extends.

5. The hermetic terminal assembly structure of claim 1 said pair of sleeve members being joined together by an intermediate neck portion to provide an integral sleeve construction through which said terminal pin passes and seals to the inner periphery thereof, the outer periphery of said intermediate neck portion sealing to the periphery of said aperture in said housing wall.

6. The hermetic terminal assembly structure of claim 1, said pin portion surrounded by said well recess including a reduced longitudinally extending fuse-like section to allow an overall length reduction of said pin portion sufficient to accommodate electrical connection.

7. The hermetic terminal structure of claim 4, said irregular indented wall portion surrounding said terminal pin with said spaced indentations being in said bottom wall of said cup shaped body, the indentations serving to strengthen and resist doming thereof.

8. The hermetic terminal assembly structure of claim 1, said pair of sleeve members being positioned in spaced, opposed relation with adjacent opposed inner end faces sealingly embedded in said coalescent bonding seal.

9. The hermetic terminal assembly structure of claim 8, said coalescent bonding seal being glass.

10. A hermetic terminal assembly structure adapted to be sealed along the periphery of an aperture in a housing wall of a compressor chamber comprising:

a cup shaped body with a bottom wall having an inner and outer face and a rim extending from said inner face of said bottom wall having the outer periphery sealed to the periphery of said housing wall aperture, said bottom wall having at least one aperture therein to accommodate a terminal electrical conducting pin to be disposed therein, said bottom wall of said cup shaped body including a plurality of preselectively shaped and spaced indentations therein positioned to surround said bottom wall aperture to thereby strengthen said bottom wall and resist possible doming thereof by high pressure variations within said compressor chamber housing wall, a terminal electrical conducting pin extending through said bottom wall aperture, said terminal pin including inner and outer pin portions extending respectively within and without said housing wall of said compressor chamber, at least said outer pin portion having a reduced longitudinally extending fuse-like section;

a coalescent glass seal extending between the periphery of said terminal pin from a location between said inner and outer pin portions to the periphery of said bottom wall aperture to hermetically seal the inner pin portion of said terminal pin within said housing wall and the outer pin portion of said terminal pin without said housing wall; and, a pair of ceramic insulating sleeve members respectively surrounding the inner and outer pin portions of said terminal pin in spaced mirror-image relationship with the proximal ends thereof in spaced and sealingly embedded relation with said coalescent glass seal and with the distal ends of said sleeve members shaped to each form a well recess surrounding a part of the peripheral surface of the inner and outer pin portions respectively to provide extended oversurfaces to reduce possible arcing of said pin portions, a major part of said fuse-like section in said outer pin portion falling within said well recess of said surrounding sleeve member.

* * * * *